United States Patent [19]

Andersson

[11] 4,444,556

[45] Apr. 24, 1984

[54] COOLING APPARATUS

[75] Inventor: Conny Andersson, Västerås, Sweden

[73] Assignee: ASEA Akt, Västerås, Sweden

[21] Appl. No.: 377,570

[22] Filed: May 12, 1982

[30] Foreign Application Priority Data

May 14, 1981 [SE] Sweden ..... 8103029

[51] Int. Cl.[3] ..... F27D 15/02; F25D 17/02; C21D 1/62

[52] U.S. Cl. ..... 432/85; 62/64; 266/113; 432/77

[58] Field of Search ..... 432/77, 85; 62/64; 266/111, 113, 114

[56] References Cited

U.S. PATENT DOCUMENTS

| | | | |
|---|---|---|---|
| 3,407,099 | 10/1968 | Schell | 266/113 |
| 3,806,366 | 4/1974 | Cofer et al. | 266/113 |
| 3,889,507 | 6/1975 | Kranenberg et al. | 266/113 |
| 4,058,262 | 11/1977 | Burnham | 62/64 |
| 4,124,932 | 11/1978 | Rogove et al. | 266/113 |
| 4,231,553 | 11/1980 | Beerens et al. | 266/113 |

FOREIGN PATENT DOCUMENTS

| | | | |
|---|---|---|---|
| 499331 | 4/1976 | U.S.S.R. | 432/85 |

*Primary Examiner*—John J. Camby
*Attorney, Agent, or Firm*—Kenyon & Kenyon

[57] ABSTRACT

A cooling apparatus for hot elongated work is formed by a tubular or generally cylindrical cluster of longitudinally extending tubes having interspaced discharge means and surrounding the work so that when the tubes are supplied with cooling fluid the work is showered on all sides.

4 Claims, 8 Drawing Figures

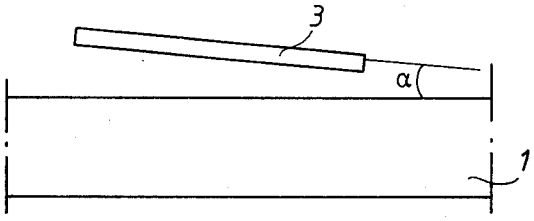
Fig. 3a
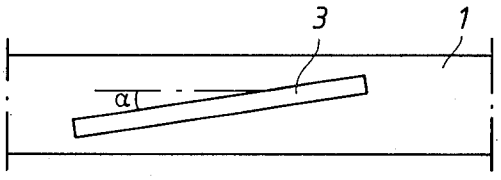
Fig. 3b
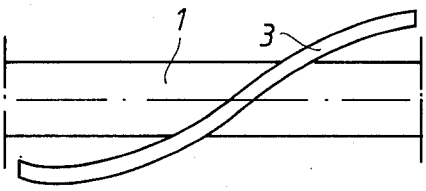
Fig. 3c
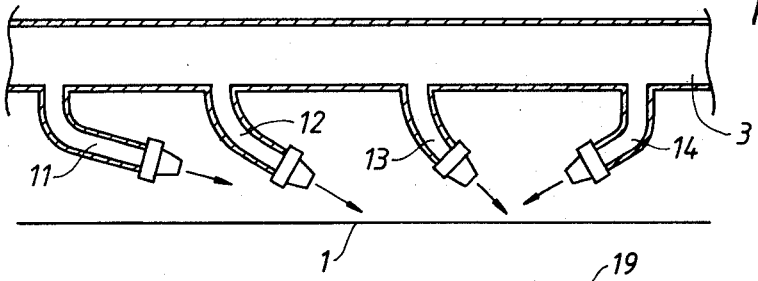
Fig. 5
Fig. 4
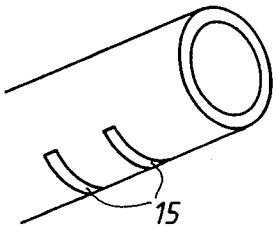
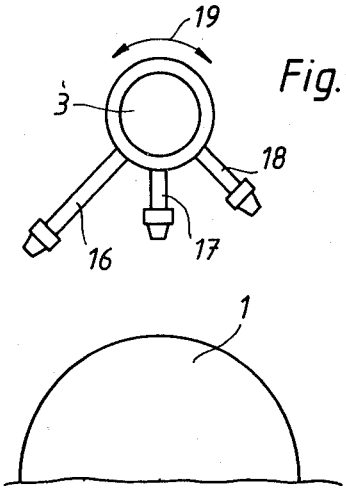
Fig. 6

COOLING APPARATUS

This invention relates to cooling apparatus of the type wherein a hot metal tube or other elongated metal product travels axially through a path extending through cooling fluid shower nozzles supplied with a fluid coolant and encircling and pointing towards the path.

This type is used, for example, when a plurality of thermally hardenable steel tubes are axially passed one after another through an induction heating furnace and then through the cooling apparatus for quenching. In one common heat treatment the tubes are heated to about 900° C. and quenched by the apparatus to about 100° C. The tubes are conveyed endwise by rotating supporting disks, and because continuously traveling, the rate of heat removal from the tubes in the time required by the heat treatment, is usually great. Uniformity of quenching is required to produce uniformly hardened and undeformed tubes.

Heretofore, the provision of the large array of cooling fluid nozzles required by this type has involved constructions which are complicated and relatively inflexible from the operating viewpoint. One example is provided by the Hemsath et al U.S. Pat. No. 4,065,252.

The object of this invention is to provide a cooling apparatus of the mentioned type, which is less complicated and provides greater operational flexibility.

As a summary, this invention comprises a tubular arrangement or array of individual tubes surrounding the path through which the hot tubes axially travel, with each tube extending longitudinally with respect to this path and having supply means for supplying it with the appropriate cooling fluid, usually water. Each tube is provided with discharge means for discharging the fluid at interspaced locations or positions along the tube and towards the hot tube's traveling path. With this concept the tubes can each have a flexible cooling fluid supply means, such as a rubber hose, permitting each tube to be individually moved in any direction relative to the other tubes as well as with respect to the hot tube being cooled.

Each tube can be individually adjusted, and the number of tubes used to form the tubular arrangement may be increased or decreased. Also, the radial spacing of the tubes relative to the hot tube's traveling path may be varied as required to cool hot tubes of differing diameters.

The tubes comprising this new cooling apparatus can be metal and individually supported by easily engineered equipment, and their arrangement may be either permanently fixed or so as to provide for any desired adjusting.

This new cooling apparatus may be used for quenching or controlled cooling of any elongated heat treatable metal product, tubes being used as the example because this type of apparatus is so often used to quench heated tubes to harden them.

The accompanying drawings schematically illustrate this invention, the various views being as follows.

FIG. 3*a* is a side elevation showing one of the cooling apparatus tubes inclined relative to the hot tube;

FIG. 3*b* shows the same excepting that this is a top view showing another possible angularity arrangement;

FIG. 3*c* is a side elevation showing the possibility of the use by the new apparatus of spiral shaped cooling fluid tubes;

FIG. 4 is a perspective view showing a simplified spray discharge means;

FIG. 5 is a longitudinal section showing another possible discharge nozzle arrangement; and FIG. 6 is an end view showing still another nozzle arrangement possibility.

Figure 1:
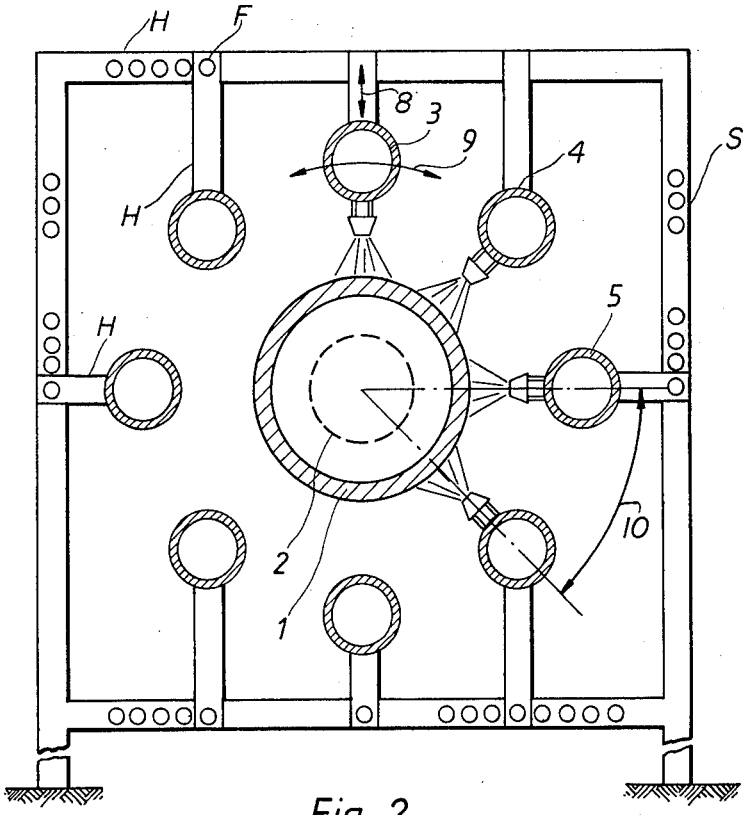
FIG. 1 is an end view of one example of the arrangement of tubes discharging the cooling fluid to one of the hot tubes.

FIG. 1 shows how either a larger hot tube 1 or a smaller hot tube 2 can be accommodated by this apparatus comprising the tubular arrangement, array or cluster of the cooling fluid tubes 3, 4, 5, etc., which are in this case symmetrically arranged around the axis of the hot tube's axial traveling path.

Figure 2:
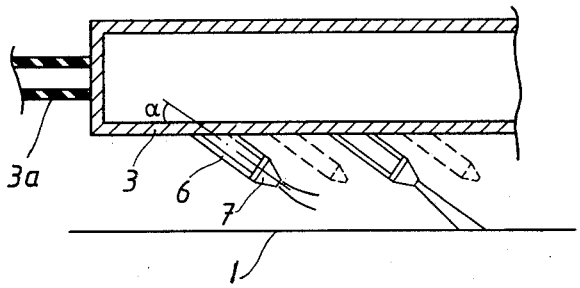
FIGS. 2 is a longitudinal section through a portion of one of the tubes showing a possible discharge nozzle arrangement.

FIG. 2 shows how any of the cooling fluid tubes may be provided by a plurality of metal pipe pieces 6 having inner ends fixed preferably by welding to the tube 3 and outer ends to which spray nozzles 7 are attached, preferably removably as by screw arrangements. FIGS. 3*a* and 3*b* show how in each instance the cooling fluid tube 3 can have its angularity varied in different ways, while FIG. 3*c* shows that each of the tubes 3 can have a spiral shape so that the arrangement of tubes can wrap around the hot tube's traveling path.

In addition to these possibilities, FIG. 1 shows by the arrow 9 how the cooling tubes 3, 4, 5, etc., can individually be moved circumferentially relative to each other while the arrow 9 shows that they can be moved circumferentially to vary their relative discharge angularities as indicated by the arrow 10. Operational flexibility is relatively unlimited.

There are no technical problems connected with mounting the various cooling fluid tubes which extend longitudinally and are arranged as a group or cluster so as to collectively encircle the hot tube being cooled. Normal bracketing, scaffolding, pipe hangers, etc., may be used for this purpose as shown in FIG. 1 where the brackets are shown at B fastened to the scaffolding S by releasable screw fastenings F. Once the assembly of cooling fluid tubes is in such a way integrated, there may never be any need to change their positions. However, metallurgy quenching techniques may often require differing spray distribution patterns and intensities, and this is easily provided by the present invention simply by rearranging the various cooling fluid tubes, FIG. 1 showing the scaffolding S provided with a series of holes H throughout for selectively receiving the fastenings F, and FIG. 2 showing at 3*a* how the cooling fluid supply means can be via flexible rubber tubes. This is desirable because in the ordinary practice of this invention the various tubes are preferably individually movable in one direction or another and possibly in all possible directions both angular and by being bodily shifted.

FIG. 5 illustrates how the discharge nozzles, mounted as shown in FIG. 2, for example, may point at differing angularities in the cooling fluid tube's axial direction, ranging from a small angularity at 11, greater angularity at 12 and maximum angularity at 13 providing the most direct hot tube impingement and therefore less chance of heat exchange being hampered because of steam blanketing. To prevent the cooling fluid from traveling upstream, the first of the nozzle may point oppositely to the others as indicated at 14, providing a back flow or dam effect.

For maximum simplicity, the cooling fluid pipes may have discharge means formed simply by the short circumferentially extending slots 15 shown by FIG. 4. In this way a very low cost and simplified cooling apparatus can be provided which, at the same time, by rearranging the array or cluster of cooling fluid pipes around the pipe to be cooled, provides great operational flexibility.

Finally, the versatility of this invention is emphasized in particular by FIG. 6 where the cooling nozzles at each position or location along the cooling fluid pipe 3 are as shown at 16, 17 and 18, extended axially at different angles relative to each other so that by rotating the pipe 3, as indicted by the arrow 19, any of the three nozzles may be ponited towards the hot pipe 1 to be cooled. With this arrangement, the nozzles may individually provide a spray pattern or orifice size differing from that of the others, rotation of the pipe 3, as indicated by the arrow 19, bringing one or the other of the nozzles to a position pointing towards the hot tube 1, the unused nozzle pipes being plugged. All three of the nozzle pipes 16, 17 and 18 can extend in a plane transverse to the cooling fluid tube's axis so that when the cooling fluid tube is rotated, the impact position of the spray or discharge on the hot tube is not shifted, although the pattern or cooling capacity of the discharge might differ.

In conclusion, it can be seen from the foregoing that the basic concept of the arrangement of the cooling fluid pipes with each of them extending longitudinally and clustered around the path the hot tube travels axially, not only permits a simple construction but one of great cooling flexibility. Expensive manifolding of the cooling fluid tubes is unnecessary because each may be supplied via rubber hoses possibly fed from a common cooling fluid source such as the usual plant water supply. The lengths of the cooling fluid tubes depends on the length of the cooling zone required, and even this can be varied by using longer or shorter cooling fluid tubes. Any mechanic can provide the construction required to support the cooling fluid tube cluster, either fixedly or preferably adjustably.

I claim:

1. A cooling apparatus of the type wherein a hot metal tube or the like is caused to travel axially through a path extending through cooling fluid shower nozzles encircling and pointing towards the path, said apparatus comprising a plurality of individual tubes, positioning means for positioning the tubes arranged as a tubular cluster surrounding said path with the tubes extending longitudinally with respect to the path, the tubes each having a supply means for individually supplying it with the cooling fluid, and the tubes each having a longitudinally extending series of interspaced discharge means for discharging the fluid towards said path.

2. The apparatus of claim 1 in which said positioning means permits the tubes to be individually moved to different positions relative to the others and said path, and said supply means in each instance is a flexible hose permitting individual movement of the tube it supplies.

3. The apparatus of claim 2 in which said discharge means comprises nozzles pointing towards said path at an acute angle.

4. The apparatus of claim 3 in which the angularities of said nozzles progressively become less acute for the length of the tubes.

* * * * *